US005118022A

United States Patent [19]

Farahnik

[11] Patent Number: 5,118,022

[45] Date of Patent: Jun. 2, 1992

[54] DEVICE FOR DISPENSING PLASTIC BAGS

[75] Inventor: Leon Farahnik, Beverly Hills, Calif.

[73] Assignee: Carlisle Plastics, Inc., Los Angeles, Calif.

[21] Appl. No.: 647,482

[22] Filed: Jan. 28, 1991

Related U.S. Application Data

[63] Continuation-in-part of Ser. No. 538,338, Jun. 14, 1990, abandoned.

[51] Int. Cl.[5] ..... B26F 3/02

[52] U.S. Cl. ..... 225/106; 225/77

[58] Field of Search ..... 225/39, 42, 77, 91, 225/52, 106

[56] References Cited

U.S. PATENT DOCUMENTS

| | | | |
|---|---|---|---|
| 634,244 | 10/1899 | Lodge | 225/52 |
| 870,445 | 11/1907 | Livermore . | |
| 936,803 | 10/1909 | Parmenter | 225/77 |
| 1,704,044 | 3/1929 | Ingram | 225/106 |
| 1,878,980 | 9/1932 | Bell et al. | 225/77 |
| 1,909,527 | 5/1933 | Fischer . | |
| 1,912,363 | 6/1933 | De Waide . | |
| 2,119,439 | 5/1938 | Parmelee | 2/8 |
| 2,382,659 | 8/1945 | Olson | 225/42 |
| 2,533,841 | 12/1950 | Russell | 242/55.5 |
| 2,580,982 | 1/1952 | Weiss | 312/50 |
| 3,098,594 | 7/1963 | Williamson | 225/18 |
| 3,229,876 | 1/1966 | Osborn, Jr. | 225/49 |
| 3,269,593 | 8/1966 | Lodewick et al. | 221/63 |
| 3,272,414 | 9/1966 | Schefer et al. | 225/45 |
| 3,291,299 | 12/1966 | Minnotte, Jr. | 206/58 |
| 3,868,052 | 2/1975 | Rockefeller | 225/106 |
| 3,986,479 | 10/1976 | Bonk | 118/506 |
| 4,017,002 | 4/1977 | Doyle et al. | 221/63 |
| 4,289,262 | 9/1981 | Finkelstein | 225/106 |
| 4,534,491 | 8/1985 | Norton et al. | 221/63 |
| 4,535,912 | 8/1985 | Bonk et al. | 221/46 |
| 4,586,630 | 5/1986 | Loder | 221/46 |
| 4,714,191 | 12/1987 | Richardson | 229/121 |
| 4,793,539 | 12/1988 | Haenni et al. | 225/106 |

FOREIGN PATENT DOCUMENTS

| | | | |
|---|---|---|---|
| 2088330 | 6/1982 | United Kingdom | 225/106 |

*Primary Examiner*—Hien H. Phan
*Attorney, Agent, or Firm*—Darby & Darby

[57] ABSTRACT

A dispenser is provided for facilitating the dispensing of individual bags of a roll of plastic bags. The individual bags on the roll are separated by a tear line which includes a line of perforations and a central gap. The dispenser comprises a cylindrical container which has an elongated slot in its peripheral surface substantially parallel to the axis of the container. The container slot is wide enough to permit the bags to be pulled through it and it includes a tongue in its central area adapted to engage the gap in the tear line so that it can temporarily hold each bag as it is pulled through the slot thereby enabling the user to rupture the tear line.

10 Claims, 4 Drawing Sheets

DEVICE FOR DISPENSING PLASTIC BAGS

This is a continuation-in-part of U.S. patent application Ser. No. 07/538,338 filed Jun. 14, 1990 and entitled "Device for Dispensing Plastic Bags", now abandoned.

This invention relates to a device for dispensing plastic bags. More specifically, the present invention relates to a dispensing device allowing individual plastic bags to be easily dispensed from a large roll of bags.

Plastic bags are used commonly today in many different places and for many different purposes. Very often, when a large number of bags is provided, the bags are sold in the form of a roll with a tear line between adjacent bags so that a user can separate one bag from the remaining bags of the roll by pulling on the outermost bag causing the tear line between it and the contiguous bag to rupture. Bags of this type are commonly used in supermarkets where customers may use the bags to package groceries such as fruits and vegetables.

The present invention provides a very simple and relatively inexpensive dispensing device which facilitates the dispensing of plastic bags that are provided in a roll with tear lines between the individual bags.

SUMMARY OF THE INVENTION

In accordance with the invention, the individual bags in a roll of bags are separated by a tear lines, each of which includes a gap, preferably at the center of the tear line. The dispenser is cylindrical in shape and includes a slot in its peripheral wall through which individual bags can be fed when the roll is positioned within the cylindrical dispenser. The slot includes a tongue which is adapted to engage the gap in each tear line between contiguous bags. As the bags are pulled from the dispenser, the tongue engages the gap which thereby provides a resistance, allowing the user to rupture the tear line by exerting a force on the bag.

THE DRAWINGS

DETAILED DESCRIPTION

Figure 1:
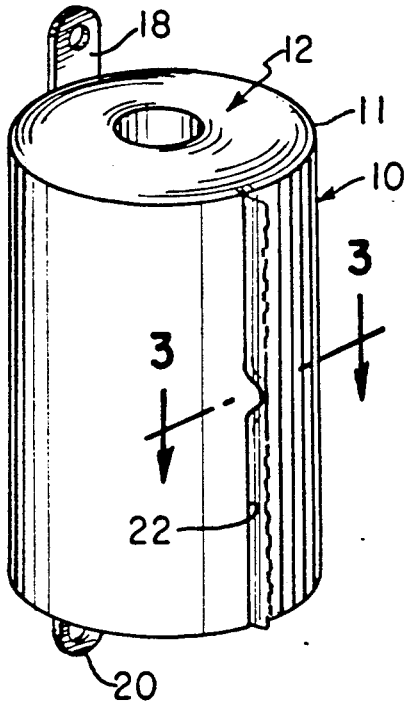
FIG. 1 is a perspective view showing the dispenser containing a roll of plastic bags with the forward portion of the outermost bag extending from the dispenser so that it can be grasped and removed.

In the drawings, the dispenser is shown at 10 and the bag of plastic bags at 12. The dispenser 10 may be made of an injection molded plastic material and comprises a cylindrical wall having an open top and a bottom or base plate 14 on which the cylindrical roll of plastic bags can rest.

The dispenser 10 may include mounting tabs 18 and 20 so that the dispensing unit can be mounted against a wall or other suitable surface. The unit will operate if it is mounted horizontally or vertically.

In accordance with the invention, an elongated longitudinal slot 22 is formed in the peripheral or circumferential wall 11 of the dispenser 10 and extends between opposing parallel edges 22A and 22B in the dispenser wall 11. The slot 22 is substantially parallel to the axis of the cylindrical dispenser 10. At its center portion it is curved to form a tongue 24 which extends from slot edge 22A. As explained below, tongue 24 is adapted to engage a suitable gap formed in a tear line between adjacent bags.

Figure 2:
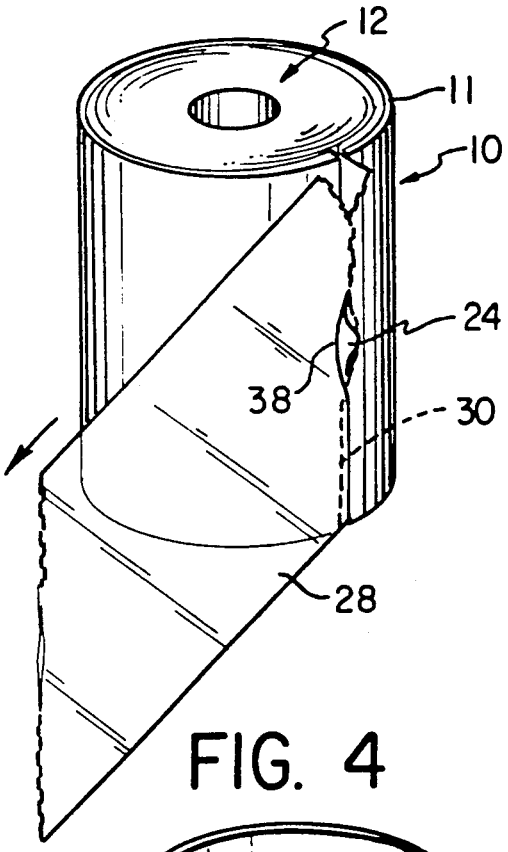
FIG. 2 is a perspective view similar to FIG. 1 showing a bag as it is pulled from the dispenser and the tear line has started to rupture.
Figure 3:
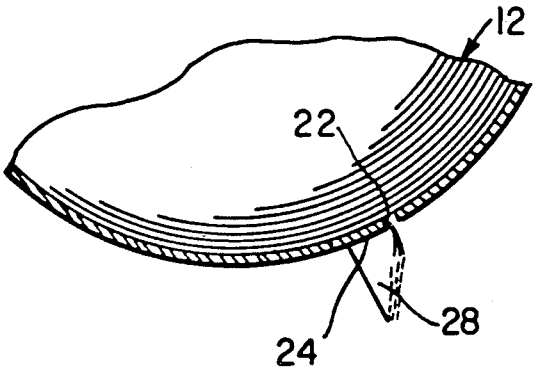
FIG. 3 is a sectional view along the line 3—3 of FIG. 1.
Figure 4:
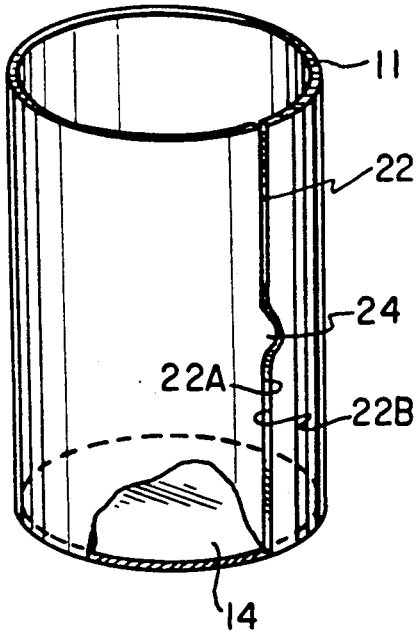
FIG. 4 is a perspective view, partially cut away, showing the dispenser alone.

Each of the bags in the roll 12 is identical. As shown in FIG. 2, each individual bag 28 is separated from the adjacent bag by a tear line 30. The tear line includes perforated sections (or other suitably weakened areas, separated by a gap 38 into which the tongue slides when the bags are pulled from the dispenser 10. Although not shown in the drawings, the individual plastic bags 28 will include a heat seal at one edge so that one end of the bag will be closed and the other end open, as is conventional. The gap 38 can be formed during the manufacturing process by a knife edge or the like at the same time the tear line is formed.

In use, a roll of bags 12 is placed within the dispenser 10 and the leading edge of the outermost bag pulled through the slot so that it can be grasped as shown in FIG. 1. To retrieve a bag, the user pulls on the exposed edge. When the outermost bag is pulled to the position shown in FIG. 2, the tongue 24 falls into the gap 38 creating a resistance to further rotation of the roll 12. This increased force causes the tear line 30 to rupture as shown in FIG. 2 so that the bag can be removed from the roll 12.

A commercial version of a dispenser made in accordance with the principles of the invention is shown in FIGS. 5-8. In FIGS. 5-8 the numerals used in describing the embodiment of FIGS. 1-4 are used to designate like parts.

Figure 5:
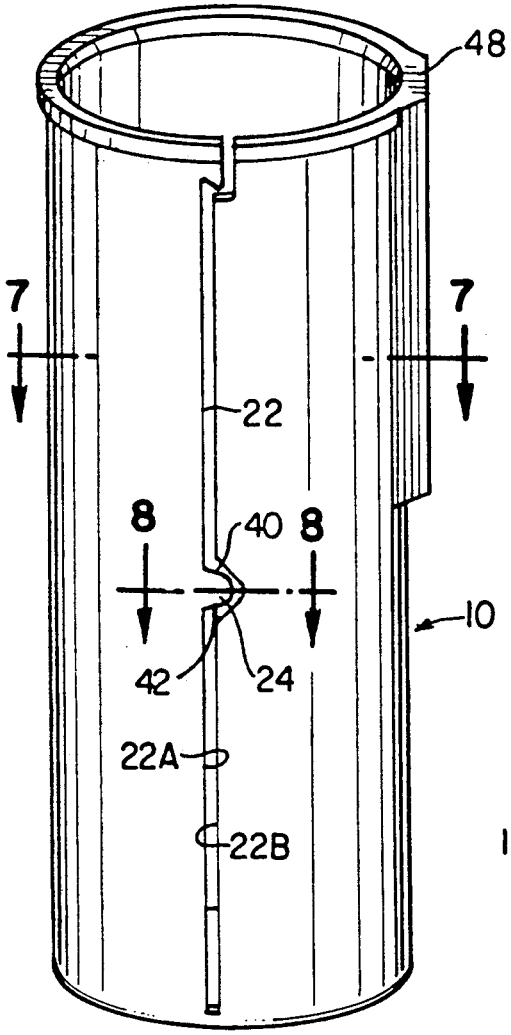
FIG. 5 is a perspective view showing a commerical embodiment of the invention.
Figure 6:
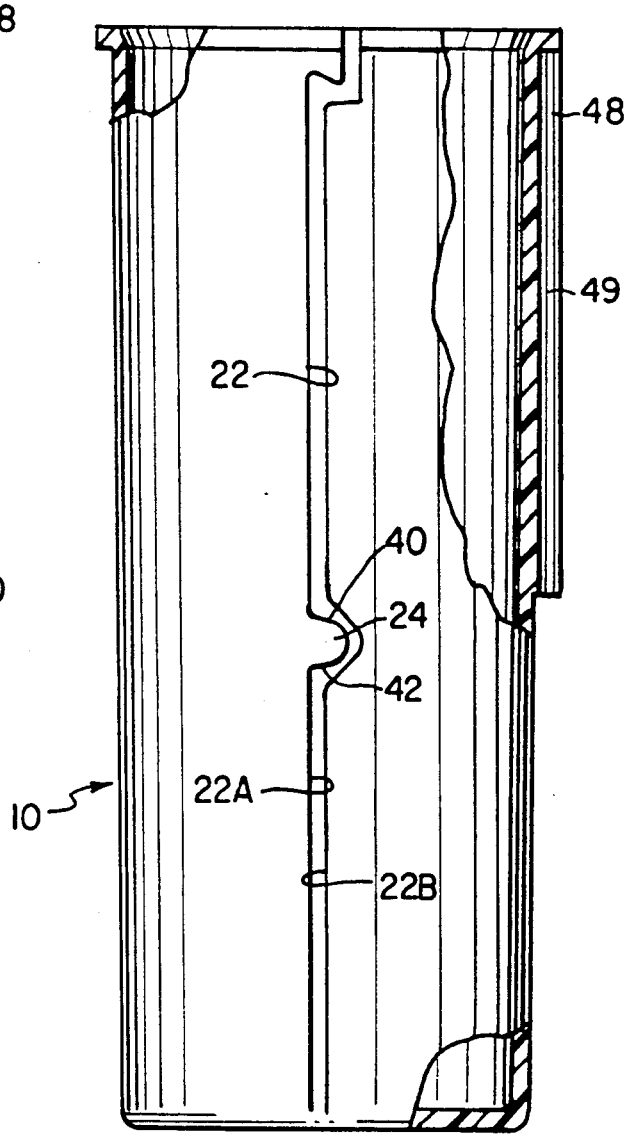
FIG. 6 is a side elevational view of the dispenser shown in FIG. 5.
Figure 7:
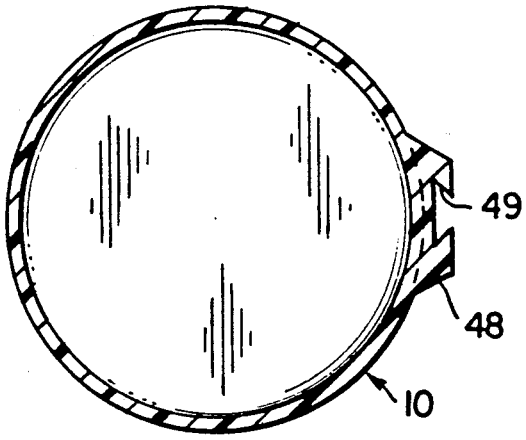
FIG. 7 is a cross-sectional view along the line 7—7 of FIG. 5.
Figure 8:
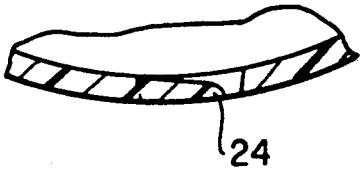
FIG. 8 is a sectional view along the line 8—8 of FIG. 5.
Figure 9:
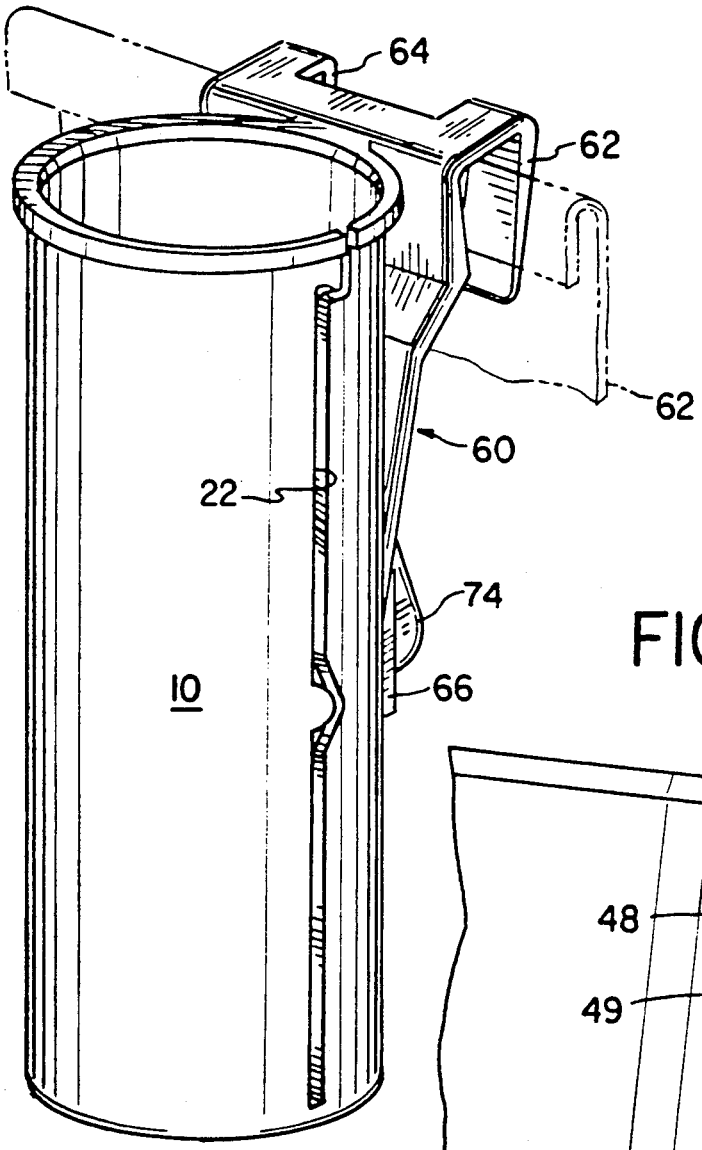
FIG. 9 is a perspective view of the dispenser of FIG. 5 mounted on a special mounting bracket in accordance with a further feature of the invention.
Figure 11:
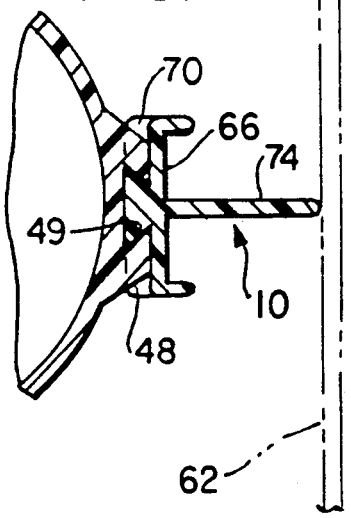
FIG. 11 is a top sectional view along the line 10—10 of of FIG. 10.
Figure 10:
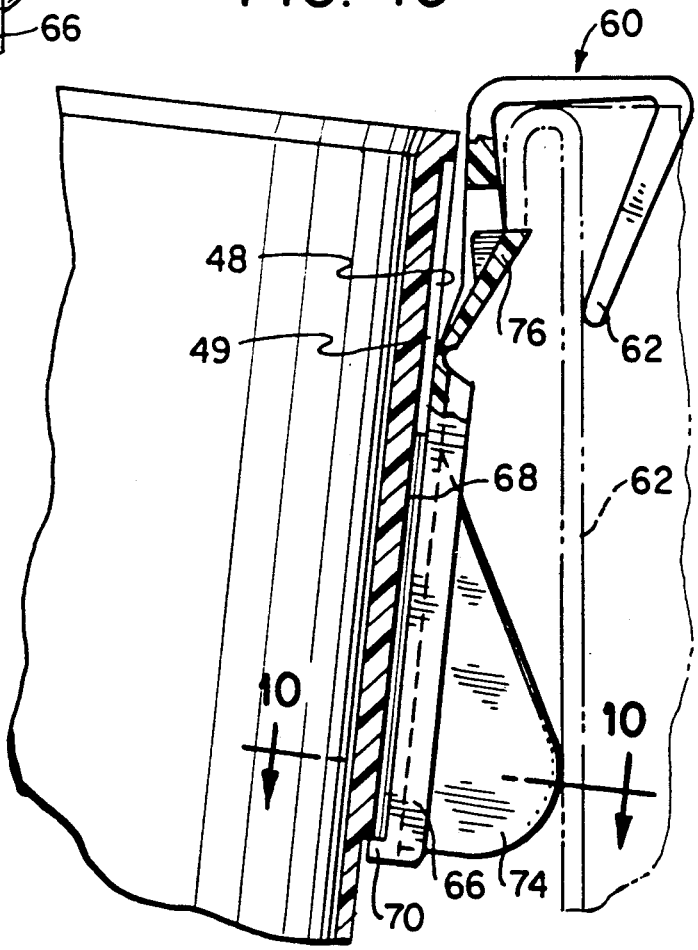
FIG. 10 is a side sectional view of a section of the dispenser and mounting bracket of FIG. 9.
Figure 12:
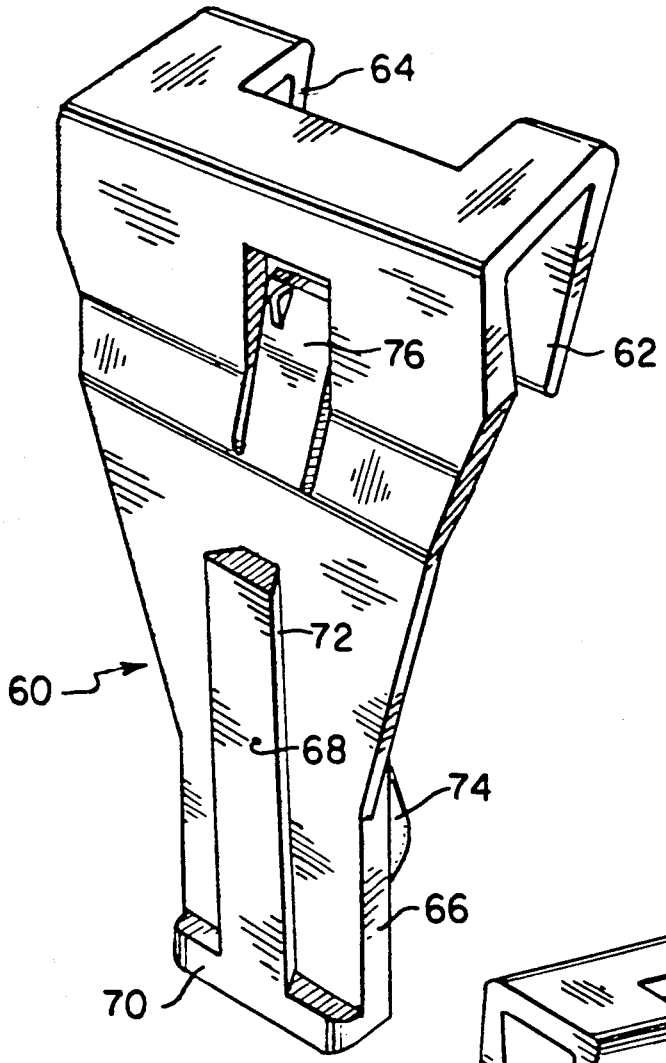
FIG. 12 is a front perspective view of the mounting bracket.
Figure 13:
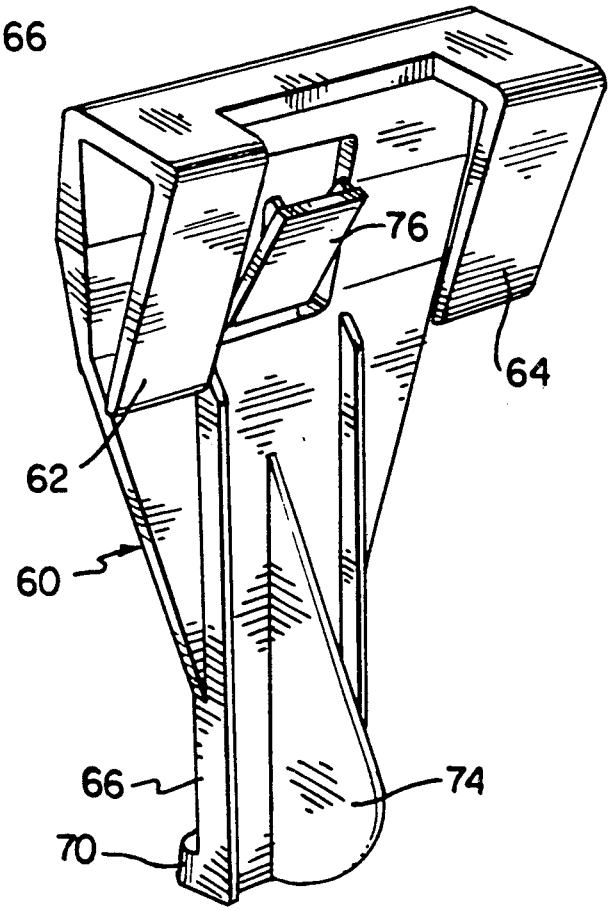
FIG. 13 is a rear perspective view of the mounting bracket.

There are two principal differences between the dispenser of FIGS. 5-8 and the dispenser shown in FIGS. 1-4. In the first place, the tongue 24 shown in FIGS. 5, 6 and 8 is relatively longer and thinner than the tongue 24 shown in FIGS. 1-5. As shown in FIGS. 5 and 6, the curve of the slot edge 22B does not conform exactly to the shape of the tongue 24 extending from the opposite slot edge 22A in the commercial version of the invention. The sides 40 and 42 of the tongue 24 are relatively steeply sloped with the apex of the tongue approximating a circular shape. The curve of edge 22B in the vicinity of the tongue is less steeply sloped and the shape of the curve of edge 22B around the tongue 24 more closely approximates a triangle. This particular configuration has been found to facilitate the movement of the perforated bags through the gap 22 during the dispensing operation.

In addition, at the upper end of the slot 22 there is an offset transverse section 46 which falls approximately at the upper extremity of the roll of plastic bags when the roll is placed within the dispenser. Thus, as the bags are pulled through slot 22, the offset transverse portion 46 tends to retain the roll of bags in the desired position with respect to the dispenser which also facilitates the movement of the tongue 24 into the gaps 38 in the perforated tear lines between adjacent bags. To further facilitate the tendency of the tongue 24 to engage a gap 38, the end of the tongue may be tapered as shown in FIG. 8.

The position of the tongue 24 is not critical although it is currently preferred that the tongue (and gap within the tear line) be centrally positioned. For some applications, two or more tongues and corresponding gaps may be employed. The invention has particular utility in dispensing plastic bags for office and residential use to line wastepaper baskets and refuse containers but, of course, can be used in any application where it is necessary to dispense individual plastic bags. The device according to the invention greatly facilitates the separation of a bag from a roll and in most cases is so easy to use that only a single hand is needed to remove the bags.

The dispenser 10 also includes an integrally formed reinforced mounting rib 48 which includes a dovetail shaped track 49 extending approximately half the length of the dispenser. Other mounting arrangements, of course, can be used with the invention but this particular mounting arrangement is advantageous for mounting the bracket on a trash container or the like.

Referring to FIGS. 9-13, a preferred mounting bracket is shown generally at 60 and the upper rim of a trash container at 62. The bracket 60 may be a single integral piece molded of a sturdy plastic material. It includes two rear hook-like portions 62 and 64 which enable the bracket 60 to be retained on the upper edge of trash container 62. The bracket includes a body portion 66 from which an elongated dovetail shaped rail 68 projects. The shapes of the rail 68 and the track 49 are complementary so that the rail 68 can be slid upwardly into track 49 until the bottom of the rib 48 abuts against a forwardly extending ledge 70 at the bottom of the track 68. The upper edge of the track 68 may be tapered slightly at shown at 72 to facilitate entry of the rail into the track. A fin 74 transverse to the body 66 is adapted to abut against the outer surface of trash container 62 so as to maintain the bracket and dispenser in a predetermined orientation with respect to the trash container. An upwardly projecting tab 76 extends outwardly from the body portion 66 near the upper portion of the bracket and is adapted to engage the under surface of the lip of the trash container 62 to further anchor the bracket on the container.

What is claimed is:

1. In combination, a dispenser and a roll of plastic bags, the individual bags of said roll being separated by a tear line including a gap in a predetermined position within said tear line, said dispenser comprising a cylindrical wall having an elongated slot formed between two spaced apart parallel edges in said cylindrical wall, said edges being substantially parallel to the axis of the container, the slot being wide enough to permit individual bags to be pulled through the slot, one of said edges being curved to form a tongue in a predetermined position corresponding to the predetermined position of the gap in the tear line of a bag, and the other of said edges being curved to form a recess in said corresponding predetermined position into which said tongue extends, side surfaces of said tongue forming a first angle, and side surfaces of said recess forming a second angle greater than said first angle to facilitate movement of the bag through said slot, said tongue being adapted to engage said gap in said tear line to temporarily hold a bag as it is pulled through said slot to enable the user to rupture the tear line and thereby permit the bags to be dispensed one at a time.

2. The combination according to claim 1, wherein said gap is centrally located in said tear line and said tongue is located in said container slot at a distance from the base of the dispenser such that the tongue will engage the gap when said roll is resting on said base.

3. The combination according to claim 2, wherein said dispenser is open at one end and closed at the opposite end to retain said roll of plastic bags.

4. The combination according to claim 1, wherein the thickness of the tongue tapers to a minimum value at its apex.

5. The combination according to claim 4, wherein the slot includes a transverse portion.

6. A dispenser for use with a roll or plastic bags, the individual bags of said roll being separated by a tear line including a gap in a predetermined position within said tear line, said dispenser comprising an elongated container having an elongated slot formed between two spaced apart parallel edges in said outer wall, the slot being wide enough to permit individual bags to be pulled through the slot, one of said edges being curved to form a tongue in a predetermined position corresponding to the predetermined position of the gap in the tear line of a bag, and the other of said edges being curved to form a cooperating recess in said corresponding predetermined position in which said tongue extends, side surfaces of said tongue forming a first angle and side surfaces of said recess forming a second angle greater than said first angle to facilitate movement of the bag through said slot, said tongue being adapted to engage said gap in said tear line to temporarily hold a bag as it is pulled through said slot to enable the user to rupture the tear line and thereby permit the bags to be dispensed one at a time.

7. A dispenser according to claim 6 wherein said tongue is centrally located in said container slot.

8. A dispenser according to claim 7, wherein said dispenser is open at one end and closed at the opposite end to retain said roll of plastic bags.

9. The dispenser according to claim 6, wherein said elongated slot includes a relatively short transverse portion near one of opposite axial ends of said dispenser to help maintain the dispenser roll in a predetermined position relative to the dispenser.

10. The dispenser according to claim 9, wherein the thickness of the tongue tapers to a minimum value at its apex.

* * * * *